US011019903B2

(12) United States Patent
Potts et al.

(10) Patent No.: US 11,019,903 B2
(45) Date of Patent: Jun. 1, 2021

(54) HEATED PADDLE HAIRBRUSH

(71) Applicant: BABYLISS FACO SPRL, Wandre (BE)

(72) Inventors: Simon Andrew Potts, Berkshire (GB); Virginia Louise Hicks, Middlesex (GB)

(73) Assignee: BABYLISS FAGO SPRL, Wandre (BE)

( * ) Notice: Subject to any disclaimer, the term of this patent is extended or adjusted under 35 U.S.C. 154(b) by 799 days.

(21) Appl. No.: 15/252,935

(22) Filed: Aug. 31, 2016

(65) Prior Publication Data

US 2018/0055188 A1 Mar. 1, 2018

(51) Int. Cl.

| | |
|---|---|
| ***A45D 20/48*** | (2006.01) |
| ***A46B 9/02*** | (2006.01) |
| ***A46B 15/00*** | (2006.01) |
| ***A45D 2/00*** | (2006.01) |
| ***A46B 9/06*** | (2006.01) |
| ***A45D 19/16*** | (2006.01) |

(52) U.S. Cl.

CPC ..... *A45D 20/48* (2013.01); *A45D 2/002* (2013.01); *A45D 19/16* (2013.01); *A46B 9/023* (2013.01); *A46B 9/028* (2013.01); *A46B 9/06* (2013.01); *A46B 15/003* (2013.01); *A45D 2200/202* (2013.01)

(58) Field of Classification Search

CPC ..... A45D 2/001; A45D 2/002; A45D 20/48; A45D 20/52; A45D 20/525; A45D 2200/202; A45D 6/00; A45D 7/00; A46B 15/0024; A46B 15/003; A46B 9/023; A46B 9/028; A46B 9/026; A46B 9/06

USPC ..... 132/224; 15/160; D4/100, 136

See application file for complete search history.

(56) References Cited

U.S. PATENT DOCUMENTS

| | | | | |
|---|---|---|---|---|
| 5,975,090 | A * | 11/1999 | Taylor | A01K 13/002 132/116 |
| D508,777 | S | 8/2005 | Kampel et al. | |
| D513,883 | S | 1/2006 | Kampel et al. | |
| D514,329 | S | 2/2006 | Kampel et al. | |
| D529,720 | S | 10/2006 | Chang | |
| D545,570 | S | 7/2007 | White et al. | |
| 7,308,899 | B2 | 12/2007 | Kampel | |
| D646,062 | S | 10/2011 | Leventhal et al. | |
| D709,705 | S | 7/2014 | Brown | |
| 8,857,005 | B2 | 10/2014 | Shim et al. | |
| D721,502 | S | 1/2015 | Michel | |
| D721,506 | S | 1/2015 | Schuler | |
| D766,589 | S | 9/2016 | Cheung | |
| 2004/0250831 | A1* | 12/2004 | Rizzuto | A45D 2/002 132/271 |
| 2007/0286831 | A1* | 12/2007 | Kamada | A45D 40/262 424/70.7 |
| 2008/0223387 | A1* | 9/2008 | Julemont | A45D 2/002 132/118 |
| 2009/0147081 | A1 | 6/2009 | Hanson | |

(Continued)

*Primary Examiner* — Yogesh P Patel
*Assistant Examiner* — Jennifer Gill
(74) *Attorney, Agent, or Firm* — Lawrence Cruz, Esq.; Ryan, Mason & Lewis, LLP

(57) ABSTRACT

A heated paddle hairbrush includes a novel bristle arrangement which establishes a large surface area for contacting the length of hair during grooming while also creating a serpentinous path through which the length of hair must traverse thereby enhancing the grooming effect on the hair.

16 Claims, 5 Drawing Sheets

(56) References Cited

U.S. PATENT DOCUMENTS

| | | | | |
|---|---|---|---|---|
| 2012/0167323 | A1* | 7/2012 | Williams | A46B 9/06 15/160 |
| 2014/0075694 | A1* | 3/2014 | Toh | A45D 4/06 15/160 |
| 2015/0101139 | A1* | 4/2015 | Guy-Rabi | A46B 9/06 15/207.2 |
| 2015/0135455 | A1 | 5/2015 | Reusche et al. | |
| 2016/0262518 | A1* | 9/2016 | Guy-Rabi | A46B 3/005 |
| 2017/0208915 | A1* | 7/2017 | Richmond | A45D 20/10 |
| 2019/0150583 | A1* | 5/2019 | Hein | A46B 15/0016 |

* cited by examiner

HEATED PADDLE HAIRBRUSH

BACKGROUND

1. Technical Field

The present disclosure relates to a hair styling apparatus, and, in particular, relates to a heated hair paddle having a novel bristle arrangement adapted to maximize exposure of the hair to heat, facilitate detanglement and massage the scalp.

2. Background of the Related Art

Various hair styling devices are commonly known in the art including hair brushes, combs and hair dryers. Examples of such hair styling devices are disclosed in commonly assigned U.S. Pat. No. 7,308,899 and Des. Pat. Nos.: 508, 777, 514,329 and 545,570, the entire contents of each disclosure being incorporated by reference herein.

SUMMARY

Accordingly, the present disclosure relates to further improvements in hair styling devices or brushes. In accordance with one embodiment, a heated hair paddle includes a brush head defining a central longitudinal x-axis extending along a length of the brush head, a y-axis orthogonal to the longitudinal x-axis extending along a width of the brush head, and a z-axis extending along a height of the brush head. A plurality of first bristles depends from the brush head. The first bristles have a dimension along the y-axis greater than a corresponding dimension along the x-axis to provide an increased surface area to contact a length of hair along the y-axis of each first bristle. The first bristles comprise a thermally conductive material. A plurality of second bristles depends from the brush head. The second bristles have a dimension along the z-axis greater than a corresponding dimension along the z-axis of the first bristles to minimize the potential of contact of the scalp with the thermally conductive first bristles. A plurality of third bristles depends from the brush head. The third bristles are more rigid than the second bristles, and provide a gross straightening effect on the length of hair. A heater is thermally coupled to the first bristles to convey heat to the first bristles whereby the first bristles convey heat to a length of hair.

The first, second and third bristles each may be arranged to define a plurality of respective first, second and third rows extending along the longitudinal axis of the brush head. The first bristles may have one of an elliptical, oval or oblong cross-section. The first bristles may comprise aluminum, the second bristles may comprise silicone and the third bristles may comprise nylon.

The heated hair paddle may include an inner first row of the first bristles radial outward of each side of the central longitudinal axis, an inner second row of the second bristles radial outward of each of the inner first rows of the first bristles, an outer first row of the first bristles radial outward of each of the inner second row of the second bristles, an outer second row of the second bristles radial outward of each of the outer first rows of the first bristles, and an outer third row of the third bristles radial outward of each of the outer second rows of the second bristles.

The inner first rows of the first bristles on each side of the central longitudinal axis may be longitudinally displaced with respect to each other. The outer first rows of the first bristles on each side of the central longitudinal axis may be longitudinally displaced with respect to each other. In some embodiments, the inner first row of the first bristles is longitudinally aligned with the outer first row of the first bristles on the opposed side of the central longitudinal axis.

The heated hair paddle may include a base to which the first rows of bristles are secured. The base may define a plurality of apertures for reception of the second bristles of the second rows. The base may comprise a thermally conductive material. The base and the first bristles of the first rows may be monolithically formed.

The heated hair paddle further may include an ion port extending through the base for directing charged ions to the hair.

The heated hair paddle of the present disclosure provides a novel bristle arrangement which establishes a large surface area for contacting the length of hair during grooming while also creating a serpentinous path through which the length of hair must traverse thereby subjecting the hair to heat treatment for an extended period of time and thus enhancing the grooming effect.

Other advantages of the present disclosure will be appreciated by the following description.

BRIEF DESCRIPTION OF THE DRAWINGS

Various embodiments of the present disclosure are described hereinbelow with references to the drawings, wherein.

DETAILED DESCRIPTION OF THE EMBODIMENT(S)

Figure 1:
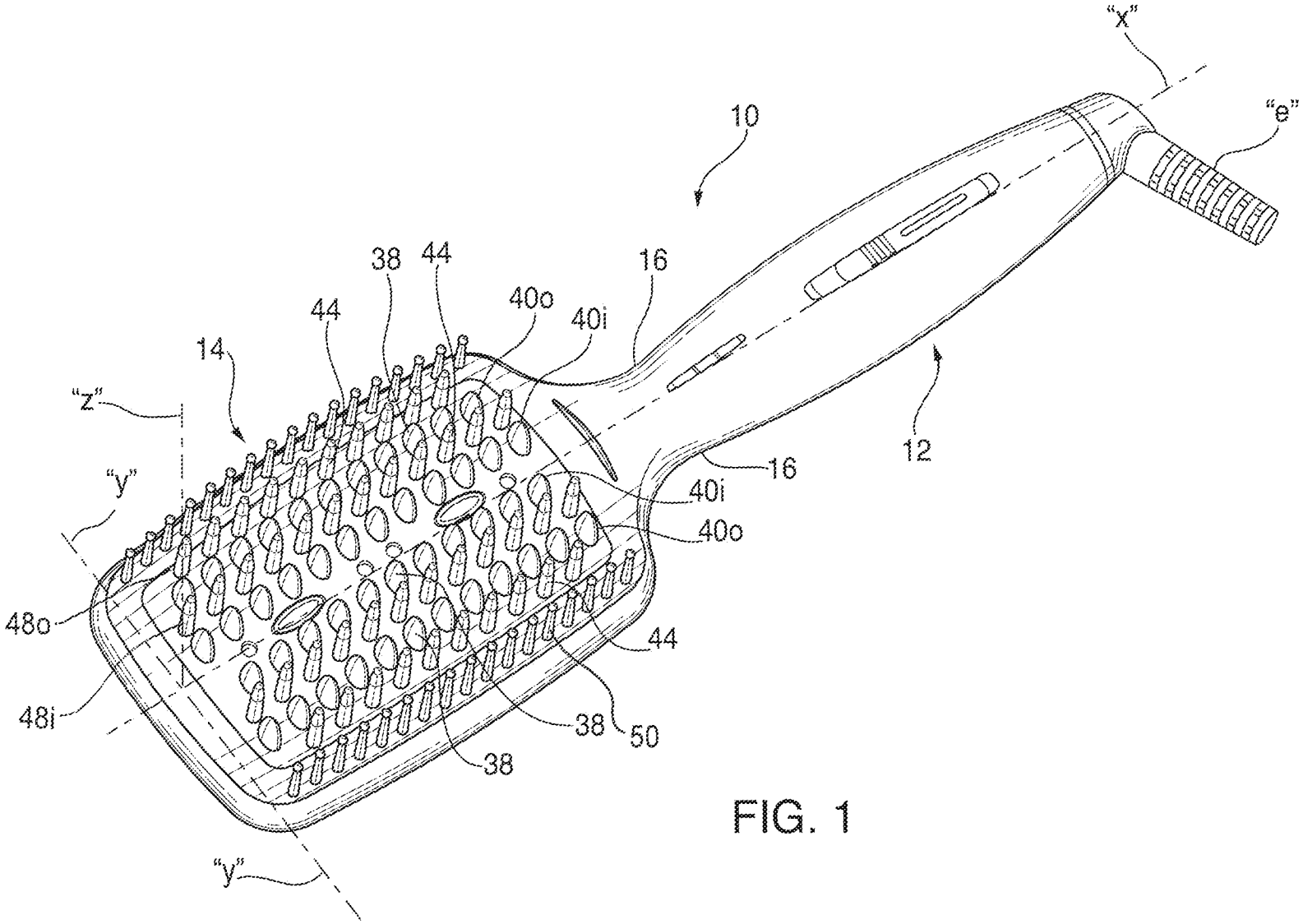
FIG. 1 is a perspective view of the heated hair paddle in accordance with the principles of the present disclosure.

Referring now to the drawings wherein like reference numerals identify similar components throughout the several views, FIG. 1 illustrates the heated hair paddle 10 in accordance with the principles of the present disclosure. In this embodiment, the heated hair paddle 10 is a hair styling apparatus in the form of a hair brush or comb having the capability to apply heat and, optionally, a concentration of ions to a length of hair traversing the hair paddle 10.

The hair paddle 10 includes a handle 12 and a brush head 14 extending from the handle 12, which may be connected to, or integrally formed, with the handle 12. The handle 12 may define contoured outer surface(s) 16 to facilitate engagement by the user. The brush head 14 defines a central longitudinal x-axis extending along the length of the brush head 14, an orthogonal y-axis extending along the width of the brush head 14 and orthogonal to the x-axis, and a z-axis extending along the height of the brush head 14.

Figure 2:
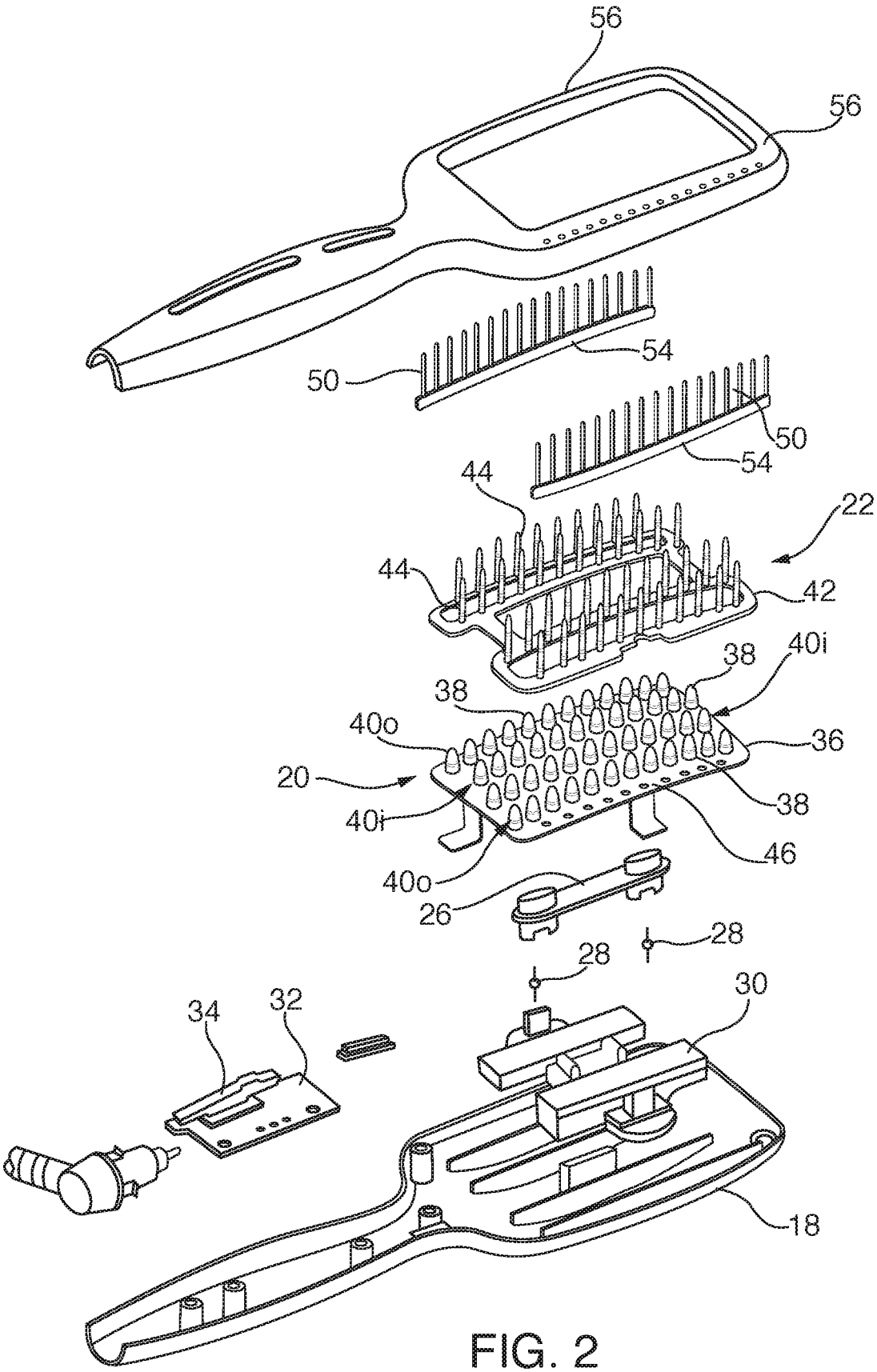
FIG. 2 is an exploded perspective view of the heated hair paddle.

With reference to FIG. 2, in conjunction with FIG. 1, the hair paddle 10 includes housing half sections 18 which are coupled to each other to define the handle 12 and the brush head 14. The housing half sections 18 may be connected with the use of fasteners, screws or the like. The hair paddle 10 further includes three bristle components, namely, a first bristle component 20, a second bristle component 22 and a third bristle component 24. The bristle components 20, 22 and 24 cooperate to style and apply heat to a length of hair as will be discussed in greater detail hereinbelow. The hair paddle 10 further includes an ion generator 26 having a pair of ion ports 28 for distribution of a concentration of ions to the length of hair, and a heater 30. The hair paddle 10 further includes a circuit board 32 having software and/or logic to control operation of the hair paddle 10. One or more switches 34 may be mounted to the handle 12 to control operation of the components of the hair paddle 10 including the ion generator 26 and the heater 30. An electrical cord "e" (FIG. 1) is coupled to the handle 12 and is an electrical communication with the circuit board 32 to power the components of the hair paddle 10. Alternatively, or optionally, the hair paddle 10 may include a battery, e.g., a rechargeable battery, to power the components of the hair paddle 10.

Figure 3:
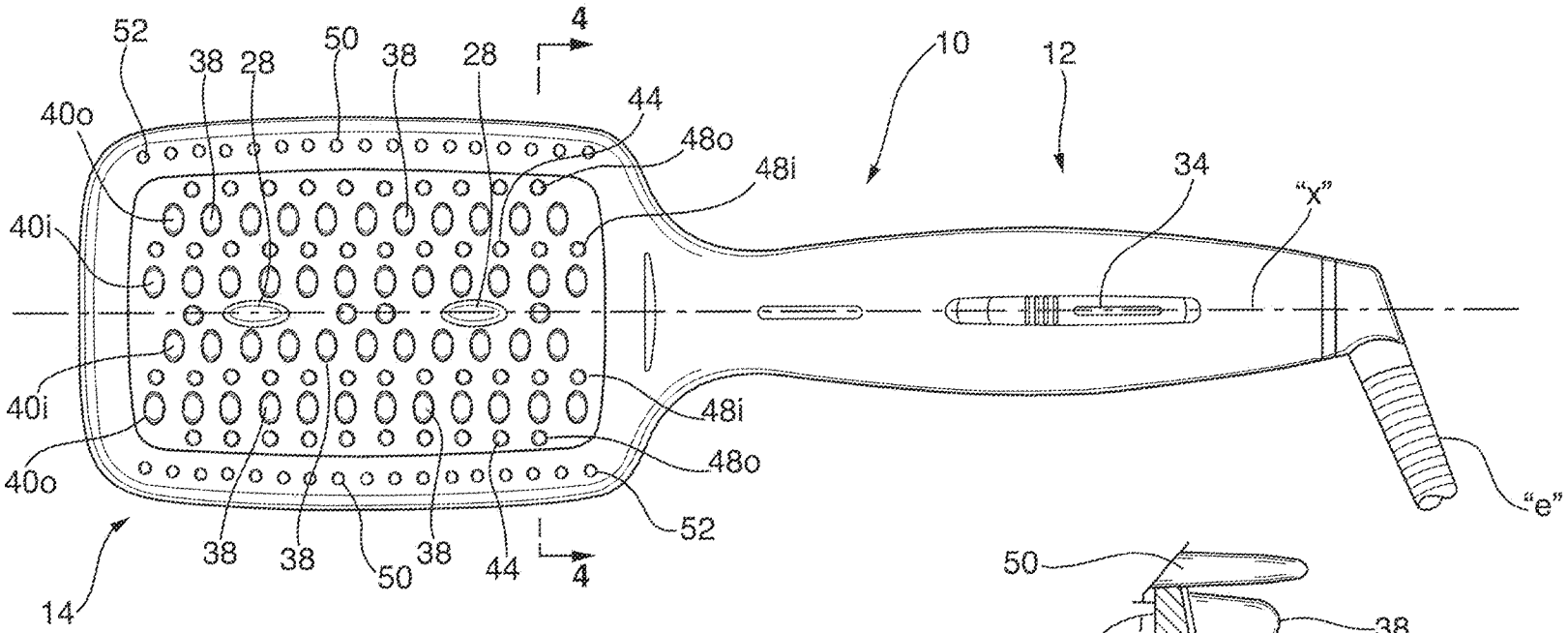
FIG. 3 is a top plan view of the heated hair paddle.
Figure 4:
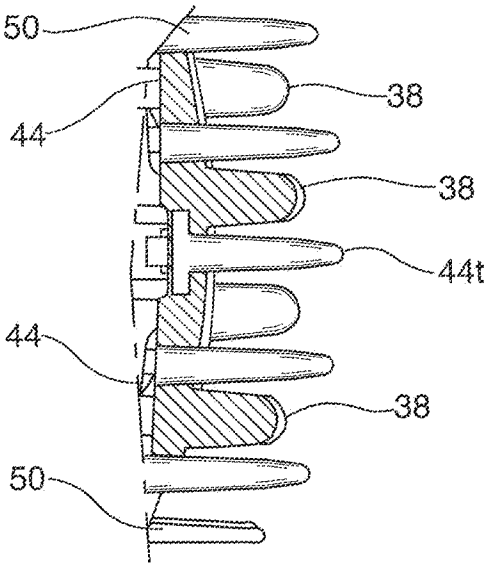
FIG. 4 is a cross-sectional view taken along the lines 4-4 of FIG. 3.
Figure 6:
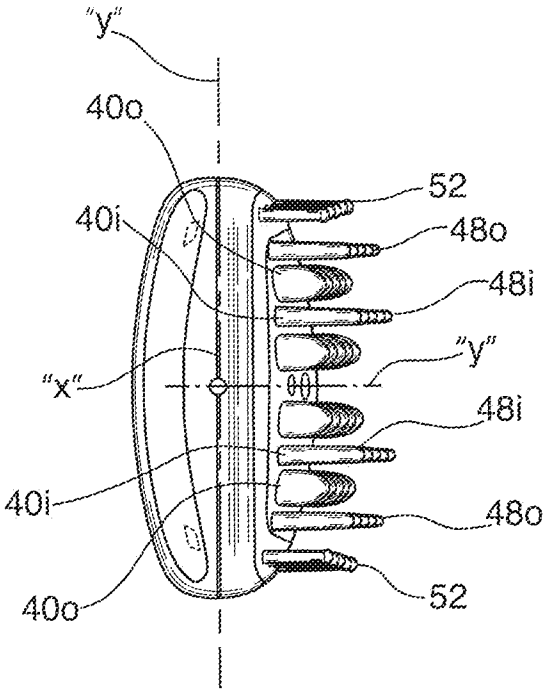
FIGS. 5-6 are rear and frontal axial views respectively of the heated hair paddle.
Figure 5:
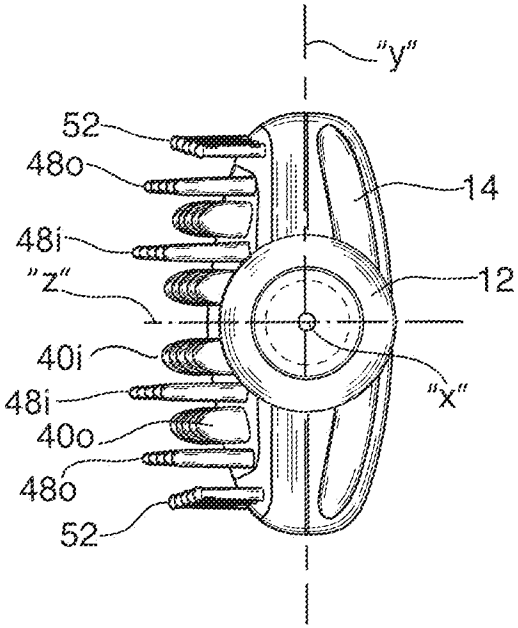

With reference to FIGS. 3-4, in conjunction with FIG. 2, the first bristle component 20 includes a first base 36 and four sets of first bristles 38 extending outwardly from the first base 36 and arranged longitudinally along linear rows, e.g., four linear rows, with respect to the central longitudinal axis x. The first base 36 is in thermal communication with the heater 30 and communicates thermal energy to the first bristles 38. In one embodiment, the first base 36 and the first bristles 38 are monolithically formed of a thermally conductive material such as aluminum or steel. The first bristles 38 each define a dimension along the orthogonal y-axis which is greater than the dimension along the central longitudinal x-axis. For example, the first bristles 38 may define a generally elliptical, oblong or oval configuration in cross-section which gradually tapers or narrows in dimension away from the brush head 14. (FIG. 4) The elliptical, oblong or oval configuration increases the surface area which contacts the length of hair as the brush head 14 passes through the length of hair. In addition, the first bristles 38 are in thermal communication with the heater 30 through the first base 36 to distribute heat to the length of hair. Two spaced rows of the first bristles 38 are on one side of the central longitudinal axis x, e.g., on the left side of the central longitudinal axis x, and two spaced rows of the first bristles 38 are disposed on the other side of the central longitudinal axis x, e.g., on the right side of the central longitudinal axis x. Thus, the arrangement defines inner first rows 40*i* of the first bristles 38 on the left and right sides of the central longitudinal axis x and outer first rows 40*o* of the first bristles 38 on the left and right sides of the central longitudinal axis x. FIGS. 5-6 illustrate the arrangement of the inner first rows 40*i* and the outer first rows 40*o*.

As best depicted in FIG. 3, the inner first rows 40*i* are misaligned or longitudinally displaced with respect to each other and the outer first rows 40*o* are misaligned or longitudinally displaced with respect to each other; however, the inner first row 40*i* on the left side of the central longitudinal axis x is longitudinally aligned with the outer first row 40*o* on the right side of the central longitudinal axis x, and the inner first row 40*i* on the right side of the central longitudinal axis x is longitudinally aligned with the outer first row 40*o* on the left side of the central longitudinal axis x. This arrangement facilitates the brushing/combing effect on hair by causing the length of hair to pass through the serpentinous path defined by the alternating displaced and aligned sets of first bristles 38 while also subjecting the length of hair to heat for a greater duration of time thereby also enhancing the grooming effect on the length of hair.

Referring to FIGS. 2-4, the second bristle component 22 includes a second base 42 and four sets of second bristles 44 extending outwardly from the second base 42 and arranged along linear rows, e.g., four linear rows extending along the central longitudinal axis x. The second bristles 44 each define a dimension along the z-axis which is greater than the corresponding dimension of the first bristles 38 along the z-axis. Thus, the second bristles 44 are configured to prevent the heated first bristles 38 from contacting the scalp of the subject. The second bristles 44 are more flexible than the first bristles 38, and are capable of flexing in a manner which prevents tangling while aligning and grooming the length of hair. In embodiments, the second bristles 44 define a circular cross-sectional dimension and may gradually taper away from the brush head 14 to define a conical tip segment 44*t*. The second bristles 44 of the second bristle component 22 extend through correspondingly dimensioned and positioned apertures 46 of the first base 36 of the first bristle component 20. (FIG. 2)

As best depicted in FIGS. 3, 5 and 6, two spaced rows of the second bristles 44 are on one side of the central longitudinal axis x, e.g., on the left side of the central longitudinal axis x and two spaced rows of the second bristles 44 are disposed on the other side of the central longitudinal axis x, e.g., on the right side of the central longitudinal axis x. Thus, the arrangement defines inner second rows 48*i* of the second bristles 44 on the left and right sides of the central longitudinal axis x and disposed between the inner and outer first rows 40*i*, 40*o* of the first bristles 38, and outer second rows 48*o* of the second bristles 44 on the left and right sides of the central longitudinal axis x and disposed radial outward of the outer first rows 40*o* of the first bristles 38. The inner and outer second rows 48*i*, 48*o* are each longitudinally aligned with each other.

The third bristle component 24 includes two rows of third bristles 50 disposed radially outward of the first and second rows of the first and second bristles 38, 44, e.g., along the outer edges of the brush head 14. One row 52 is on the left side of the central longitudinal axis x and the other row 52 is on the right side. As best depicted in FIG. 2, each row depends from a base 54 with the third bristles 50 extending through apertures 56 within the housing half section 18. The third bristles 50 may be circular in cross-section and include a bulbous tip 50*b*. The third bristles 50 are fabricated from a rigid polymeric material and have a smaller cross-section or diameter than the second bristles 44. These characteristics allow the third bristles 50 to more effectively and aggressively part the hair to initiate and ease passing of the first and second bristles 38, 44.

Figure 7:
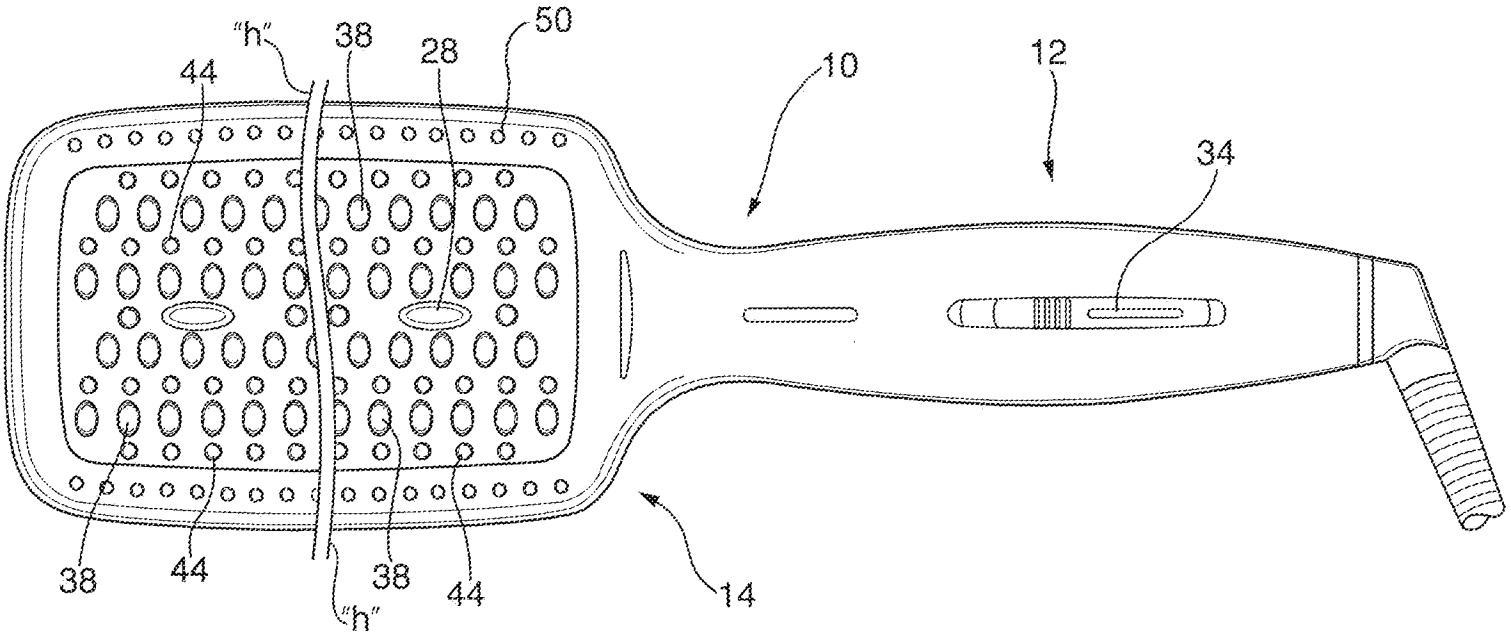
FIG. 7 is a top plan view of the heated hair paddle in use in grooming a subject's hair.

With reference now to FIG. 7, during application in grooming a subject's hair, strands "h" of the length of hair are initially engaged by the third bristles 50 which, due to at least in part to their rigidity, perform a gross straightening effect on the hair. As the strands "h" of hair passes across the brush head 14, the second flexible bristles 44 minimize entanglement, and guide the strands of hair through the first bristles 38. As noted above, the enlarged elliptical, oblong or oval configuration, in conjunction with the serpentinous path, provided by the first bristles 38, establishes a large surface area contacting the strands "h" of hair while increasing the duration of time to which the length of hair is subjected to heat. In addition, the ion ports 28 direct charged particles into the length of hair to restore balance, create a shiny appearance, and further smooth the hair.

Any of the first, second and third bristles 38, 44, 50 may have a hair treatment solutions or coating including, but not limited to, Argan oil. moisturizers, hydration agents, penetration agents, preservatives, emulsifiers, natural or synthetic oils, solvents, surfactants, detergents, gelling agents, emollients, antioxidants, fragrances, fillers, thickeners, waxes, odor absorbers, dyestuffs, coloring agents, powders, viscosity-controlling agents, buffers, protectants, pH regulators, chelating agents, humectants, conditioners, glitter, mica, minerals, silicones, polyphenols, sunblocks, phytomedicinals, and combinations thereof, as well as other additives typically used in hair care products as appreciated by those skilled in the art.

Although the illustrative embodiments of the present disclosure have been described herein with reference to the accompanying drawings, the above description, disclosure, and figures should not be construed as limiting, but merely as exemplifications of particular embodiments. It is to be understood, therefore, that the disclosure is not limited to those precise embodiments, and that various other changes and modifications may be effected therein by one skilled in the art without departing from the scope or spirit of the disclosure.

What is claimed is:

1. A heated paddle brush, which comprises:

a brush head defining a central longitudinal x-axis extending along a length of the brush head, a lateral y-axis orthogonal to the central longitudinal x-axis extending along a width of the brush head and a z-axis extending orthogonal to the y-axis and orthogonal to the central longitudinal x-axis along a height of the brush head;

a first inner row of first bristles depending from the brush head on each side of the central longitudinal x-axis, the first inner rows of the first bristles laterally spaced along the y-axis from the central longitudinal x-axis;

a second inner row of second bristles depending from the brush head on each side of the central longitudinal x-axis, the second inner rows of the second bristles laterally spaced along the y-axis from the central longitudinal x-axis and laterally outward of the first inner rows of the first bristles;

a first outer row of the first bristles depending from the brush head on each side of the central longitudinal x-axis, the first outer rows of the first bristles laterally spaced along the y-axis from the central longitudinal x-axis and laterally outward of the second inner rows of the second bristles;

a second outer row of the second bristles depending from the brush head on each side of the central longitudinal axis, the second outer rows of the second bristles laterally spaced along the y-axis from the central longitudinal x-axis and laterally outward of the first outer rows of the first bristles; and a third outer row of third bristles depending from the brush head on each side of the central longitudinal axis, the third outer rows of the third bristles laterally spaced along the y-axis from the central longitudinal x-axis and laterally outward of the second outer rows of the second bristles;

wherein each of the first bristles has a dimension along the y-axis greater than a corresponding dimension along the central longitudinal x-axis to provide an increased surface area along the y-axis of each first bristle, the first bristles comprising a thermally conductive material;

wherein each of the second bristles has a height along the z-axis greater than a corresponding height along the z-axis of each of the first bristles;

wherein the third bristles are more rigid than the second bristles; and wherein a heater is thermally coupled to the first bristles to convey heat to the first bristles such that the first bristles convey heat to a length of hair; wherein the second and third bristles are made of a non-thermally conductive material.

2. The heated paddle brush according to claim 1 wherein the first bristles have one of: an elliptical, oval or oblong cross-section.

3. The heated paddle brush according to claim 2 wherein wherein the thermally conductive material of the first bristles comprises aluminum, wherein the non-thermally conductive material of the second bristles comprises silicone, and wherein the non-thermally conductive material of the third bristles comprises nylon.

4. The heated paddle brush according to claim 1 wherein the first inner rows of the first bristles on each side of the central longitudinal x-axis are longitudinally displaced with respect to each other.

5. The heated paddle brush according to claim 4 wherein the first outer rows of the first bristles on each side of the central longitudinal x-axis are longitudinally displaced with respect to each other.

6. The heated paddle brush according to claim 5 wherein the first inner row of the first bristles on one side of the central longitudinal x-axis is longitudinally aligned with the first outer row of the first bristles on an opposed side of the central longitudinal x-axis.

7. The heated paddle brush according to claim 1 including a base to which the first bristles of the first inner and the first outer rows are secured, the base defining a plurality of apertures for reception of the second bristles of the second inner and the second outer rows.

8. The heated paddle brush according to claim 7 wherein the base comprises a thermally conductive material.

9. The heated paddle brush according to claim 8 wherein the base and the first bristles of the first inner and the first outer rows are a monolithic component.

10. The heated paddle brush according to claim 7 including an ion port extending through the base for directing charged ions to the length of hair.

11. The heated paddle brush according to claim 1 wherein each of the first bristles are identical, wherein each of the second bristles are identical and wherein each of the third bristles are identical.

12. The heated paddle bush according to claim 1:

wherein each of the first inner rows of the first bristles extend parallel to the central longitudinal x-axis;

wherein each of the second inner rows of the second bristles extend parallel to the central longitudinal x-axis;

wherein each of the first outer rows of the first bristles extend parallel to the central longitudinal x-axis;

wherein each of the second outer rows of the second bristles extend parallel to the central longitudinal x-axis; and wherein each of the third outer rows of the third bristles extend parallel to the central longitudinal x-axis.

13. The heated paddle brush according to claim 12 wherein the first inner rows of the first bristles on each side of the central longitudinal x-axis are longitudinally displaced with respect to each other.

14. The heated paddle brush according to claim 13 wherein the first outer rows of the first bristles on each side of the central longitudinal x-axis are longitudinally displaced with respect to each other.

15. The heated paddle brush according to claim 14 wherein the first inner row of the first bristles on one side of the central longitudinal x-axis is longitudinally aligned with the first outer row of the first bristles on an opposed side of the central longitudinal x-axis.

16. The heated paddle brush according to claim 12 including a base to which the first bristles of the first inner and the first outer rows are mounted, the base defining a plurality of apertures for reception of the second bristles of the second inner and the second outer rows, the base and the first bristles comprising a thermally conductive material.

* * * * *